US005156755A

United States Patent [19]

Cass

[11] Patent Number: 5,156,755

[45] Date of Patent: Oct. 20, 1992

[54] ADJUSTABLE APPARATUS FOR FORMING VOIDS IN CONCRETE

[76] Inventor: Ronald L. Cass, 4329 Glenwood Ave., Ft. Myers, Fla. 33905

[21] Appl. No.: 666,917

[22] Filed: Mar. 11, 1991

Related U.S. Application Data

[63] Continuation-in-part of Ser. No. 385,403, Jul. 27, 1989, Pat. No. 4,998,705.

[51] Int. Cl.[5] ..... B28B 7/30

[52] U.S. Cl. ..... 249/177; 249/39; 249/152; 249/157; 249/178; 249/184

[58] Field of Search ..... 249/39, 43, 63, 64, 249/66.1, 152, 157, 177, 178, 182, 184

[56] References Cited

U.S. PATENT DOCUMENTS

| | | | |
|---|---|---|---|
| 2,234,784 | 3/1941 | Stolz | 249/179 |
| 2,684,518 | 7/1954 | Whitlock | 249/177 |
| 2,728,126 | 12/1955 | Whitlock | 249/177 |
| 3,328,055 | 6/1967 | Lang | 249/177 |
| 3,921,953 | 11/1975 | Diener | 249/177 |
| 4,018,416 | 4/1977 | Diener | 249/177 |
| 4,365,784 | 12/1982 | De Stasio | 249/177 |

*Primary Examiner*—Jay H. Woo
*Assistant Examiner*—William J. Matney, Jr.
*Attorney, Agent, or Firm*—Fleit, Jacobson, Cohn, Price, Holman & Stern

[57] ABSTRACT

An apparatus for forming voids in concrete including baseplates secured to a wood supporting deck or form for a concrete floor by a plurality of short wood screws. An adjustable sleeve assembly is attached to each baseplate and is adjustable to a height generally equal to the thickness of the floor with the upper end of the sleeve being accessible and observable when concrete is poured. After the baseplates have been secured in place, various subsequent work procedures may be carried out without the workers encountering obstructions that would exist if upwardly projecting cavity forming members where attached to the wood deck and the sleeve assemblies are mounted prior to pouring the concrete. After the concrete has been poured and set, the sleeve assemblies and the baseplates are removed by unscrewing the sleeve assemblies, removing an upper sleeve and pulling a lower sleeve and baseplate up from the wood deck.

8 Claims, 1 Drawing Sheet

ADJUSTABLE APPARATUS FOR FORMING VOIDS IN CONCRETE

CROSS REFERENCE TO RELATED APPLICATION

This application is a continuation-in-part of Ser. No. 07/385,403 filed Jul. 27, 1989, now U.S. Pat. No. 4,998,705 issued Mar. 12, 1991.

BACKGROUND OF THE INVENTION

Field of the Invention

The present invention generally relates to the construction of concrete floors or other concrete bodies and more specifically an apparatus for forming voids therein. The apparatus includes a baseplate secured to a wood supporting deck or form for a concrete floor by a plurality of screws in locations determined by the plans of the concrete floor which usually requires the formation of various voids, cavities, openings or holes in the floor. An adjustable sleeve is attached to each baseplate and is adjustable to a height generally equal to the thickness of the floor with the upper end of the sleeve being accessible and observable when concrete is poured. In using the apparatus, the baseplates are affixed to the wood deck in accordance with the plans for the floor after the wood deck has been placed in position to receive poured concrete. After the baseplates have been secured in place, various subsequent work procedures may be carried out without the workers encountering obstructions that would exist if upwardly projecting cavity forming members were attached to the wood deck. Such work procedures include the positioning of reinforcing bars, cables and the like which have a tendency to dislodge and damage any upward projections on the wood deck. After all work procedures have been performed on the wood deck, including positioning of rebars, an adjustable sleeve is attached to each baseplate and adjusted immediately prior to pouring concrete thereby eliminating the problem of upwardly projecting cavity forming members on the wood deck being displaced or damaged during work procedures prior to pouring concrete. After the concrete has been poured and set, the sleeves and baseplates are removed by pulling the baseplate retaining screws out of the wood deck for reuse. The wood deck can then be stripped from the bottom of the concrete floor for reuse.

INFORMATION DISCLOSURE STATEMENT

In present day building structures, it is necessary to form voids or openings in concrete floors when the floors are poured. The openings in concrete floors are necessary to receive cables, wiring, plumbing and the like which is installed in the building after all of the concrete floors have been formed. Various efforts have been made to form the voids or openings including the provision of sleeve structures and the like that are attached to the wood deck onto which the concrete floor is to be poured with these sleeve members projecting upwardly from the wood deck thereby forming obstructions to workers who are performing various work procedures on the wood deck including workers that are positioning rebars. It frequently occurs that the upwardly projecting sleeves are damaged or displaced during various work procedures and the upwardly projecting sleeves also form obstructions over which workers can trip and fall with resultant injury.

The following disclose various structures endeavoring to provide voids or openings in a concrete floor:

U.S. Pat. No. Re. 31,598
U.S. Pat. No. 762,194
U.S. Pat. No. 1,391,988
U.S. Pat. No. 1,746,696
U.S. Pat. No. 2,249,824
U.S. Pat. No. 2,694,847.

While such prior art devices are related to the formation of voids or cavities in a concrete deck, none of them utilize the specific structure of this invention since none of those patents disclose baseplates secured to a wood deck prior to placement of rebars thereon with adjustable sleeves being attached to the baseplates and adjusted as to vertical height just prior to pouring concrete with the sleeves and baseplates being removed from the upper surface of the set concrete by exerting an upward force on the sleeves and baseplates.

SUMMARY OF THE INVENTION

An object of the present invention is to provide an apparatus for forming openings in a concrete floor or other concrete body in which the apparatus includes recoverable, reusable and adjustable components to more effectively and accurately form openings through a concrete floor or other concrete body.

Another object of the invention is to provide an apparatus in accordance with the preceding object in which the apparatus includes baseplates secured to a wood deck for a concrete floor or a form member which supports and engages a concrete mixture or other hardenable mixture which is placed on the wood deck or form member prior to work procedures being performed in adjacent relation to the baseplates and subsequently placing a sleeve on each baseplate and connecting it thereto and adjusting the vertical height thereof immediately prior to pouring the concrete mixture or similar pourable and hardenable material against the wood deck or form member with the sleeves and baseplates being removable after the concrete mixture or other hardenable mixture has set or hardened.

A further object of the invention is to provide an apparatus as set forth in the preceding objects in which each baseplate is secured to the wood deck or form member by conventional screws and the sleeve is constructed of telescopic members and is secured to the baseplate in enclosing relation thereto by a threaded rod or bolt assembly to enable adjustment of the height of the sleeve assembly and to secure the sleeve fixedly to the baseplate and to move the sleeve away from the baseplate to facilitate extraction of the sleeve from the concrete floor or body after it hardens.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
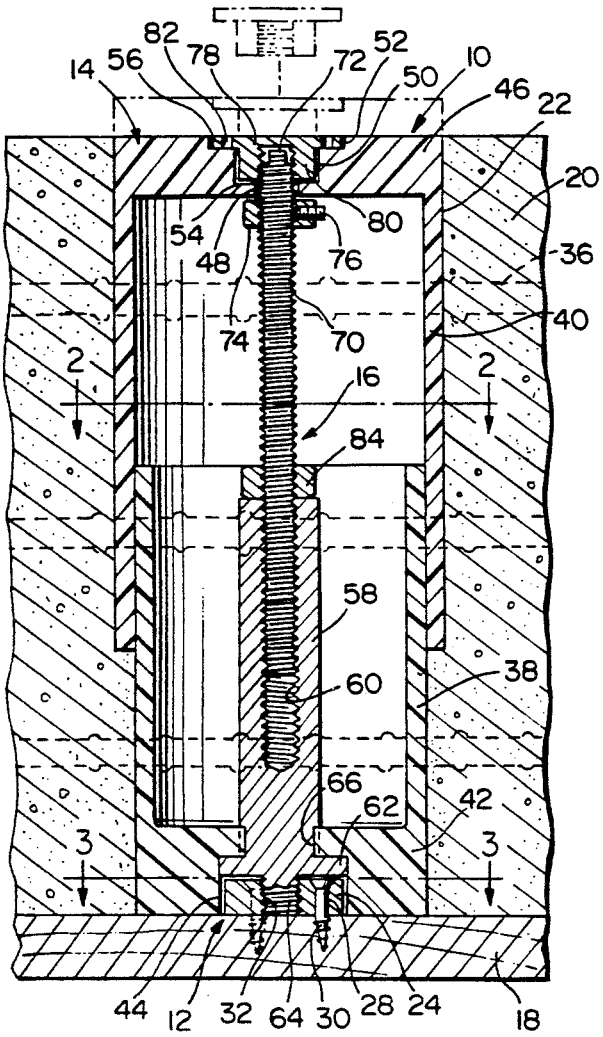
FIG. 1 is a sectional view of the apparatus of the present invention in assembled relation with a concrete floor and rebars associated therewith.

Referring now specifically to the drawings, the apparatus for forming voids or cavities in a concrete floor or other concrete body is generally designated by reference numeral 10 and includes a baseplate 12, a telescopic tubular sleeve assembly 14 and a sleeve retaining and adjusting bolt or rod 16 with these components being associated with a wood floor deck 18 which is a form member that supports and engages concrete 20 such as a concrete floor when it is poured when forming a building structure. The wood floor deck 18 conventionally employed for this purpose is constructed from plywood panels supported by a suitable framing structure. When forming concrete floors, it is necessary to provide voids, cavities or openings 22 therethrough to receive cables, wiring, plumbing and the like which is installed after the concrete floor has been constructed.

When a concrete floor is to be poured, the wood deck 18 is assembled in a manner to form a substantially planar upper surface that is horizontally disposed. In conventional practice, a plurality of upwardly projecting void or opening forming members are attached to the wooden deck in accordance with the plans for the floor. Various work procedures are then performed by workers who find it necessary to walk along the surface of the wood deck and the upwardly projecting members form obstructions which can impede a worker's progress and, in some instances, trip the worker and cause the worker to fall. Also, when installing rebars, it frequently occurs that the rebars contact the upwardly projecting members and displace them from the desired position or, in some instances, bend or deform the opening defining members and the upwardly projecting members form an obstruction to location and movement of the rebars when laying them in desired position and anchoring them in that position. In many instances, the upwardly projecting members become a permanent part of the concrete floor since they are attached to the wood deck with nails which hold the upwardly projecting members in place but still enable the wooden deck to be separated from the bottom surface of the concrete floor after it hardens. If the conventional upwardly extending member is displaced, tilted, bent or punctured, the void or cavity will be lost thus necessitating the floor to be core drilled in order to form the void. If post tensioned cable is used in the floor, it is necessary to use an expensive X-ray procedure to avoid damage to the cables.

In the present invention, the baseplate 12 is in the form of a circular plate 24 constructed of plastic, metal material or the like which may be provided with a plurality of locating notches in the periphery thereof which are aligned with chalk lines for proper positioning. The plate 24 also is provided with three equally spaced apertures 28 receiving fastener screws 30 which secure the baseplate or mounting plate 24 to the wood deck 18 with the heads of the screws 30 being countersunk into the top surface of the plate 24. The plate 24 is provided with an internally threaded bore 32 located centrally therethrough. Thus, the baseplate 12 which includes the plate 24 with the threaded bore 32 is easily attached to the wood deck 18 by using the screws 30 and the thickness of the baseplate 12 is such that it will not produce upwardly extending projections that have a height generally equal to the thickness of the concrete floor. Rather, the projection is very shallow and will enable workers to traverse the wood floor when mounted thereon. The short height of the baseplate also enables the reinforcing bars 36 to be oriented in desired relation, usually in a grid pattern and the rebars 36 are positioned in their desired relationship.

The sleeve assembly 14 is mounted on the baseplate 12 and includes a generally cylindrical lower sleeve 38 and a similar upper sleeve 40 which telescopes over the lower sleeve 38 as illustrated in FIG. 1. The bottom end of the lower sleeve 38 is provided with a bottom wall 42 having a cylindrical recess 44 therein which telescopes over the plate 24. The upper end of the upper sleeve includes a top wall 46 having an opening 48 communicating the lower surface thereof with the opening including a larger central portion 50 and a still larger upper portion 52 which defines annular shoulders 54 and 56 which face upwardly. The upper sleeve 40 closely fits around the lower sleeve 38 but can telescope vertically in order to vary the vertical height of the sleeve assembly 14 as illustrated in broken line in FIG. 1 in order to adjust the height of the sleeve assembly so that it is substantially same as the thickness or height of the concrete body 20.

The bottom wall 42 of the lower sleeve 38 includes a centrally disposed, rigidly mounted, tubular member 58 that includes an internally threaded longitudinal bore 60 extending to the upper end thereof. The lower end of the member 58 has a peripheral flange 62 and an axially extending threaded stud 64 which threads into the internally threaded bore 32 in the plate 24 to support the sleeve assembly 14 from the plate 24. The member 58 is rigidly connected with the interior of an opening 66 passing from the upper end of the recess 44 to the top surface of the bottom wall 42 with a molded spline connection 68 connecting the lower sleeve 38 and the member 58 in a rigid, non-rotative relation.

An elongated threaded rod or bolt 70 threads into the bore 60 and extends upwardly therefrom with the upper end thereof extending through the opening 48. The upper end of the threaded rod 70 is provided with a rectangular or square end 72 for receiving a wrench or similar tool to facilitate rotation of the threaded rod 70 in relation to the internally threaded member 58 to effectively adjust the vertical height of the upper end of the threaded rod 70. As illustrated, the upper end of the threaded rod 70 terminates below the upper surface of the top wall 46 and an adjustable threaded collar 74 is mounted on the threaded rod slightly below the lower surface of the top wall 46 with the threaded collar 74 being locked in position by a lock screw 76 so that when the rod 70 is rotated in one direction, the collar will engage and move the upper sleeve 40 upwardly in relation to the lower sleeve 38 and when the rod 70 is rotated in the other direction, the upper sleeve 40 can move downwardly in relation to the lower sleeve 38 thereby effectively varying the overall height of the sleeve assembly 14. A cap 78 forms a closure for the upper portion 52 of the opening through the top wall and abuts the surface of the shoulder 56. The center of the cap 78 includes a cylindrical internally threaded member 80 of reduced diameter as compared to the flange which screw threadedly engages the upper end of the rod 70 to secure the cap 78 in place. The cap is provided with circumferentially spaced apertures 82 to receive a spanner wrench or similar tool to facilitate installation and removal of the cap 78. When the cap is installed, the upper surface thereof is substantially flush with the upper surface of the top wall 46 of the upper sleeve 40. This arrangement precludes entry of concrete into the recess or opening and prevent concrete coming into contact with the upper end of the threaded rod 70 which could preclude rotation of the threaded rod 70. A lock nut 84 is mounted adjustably on the rod 70 and contacts the upper end of the tubular member 58 to retain the threaded rod 70 in adjusted position and permitting the rod 70 to be rotated in a manner to move upwardly in relation to the tubular member 58 and the lower sleeve 38 in order to elevate the upper sleeve 40 upwardly out of the concrete as illustrated by broken line in FIG. 1.

Figure 4:
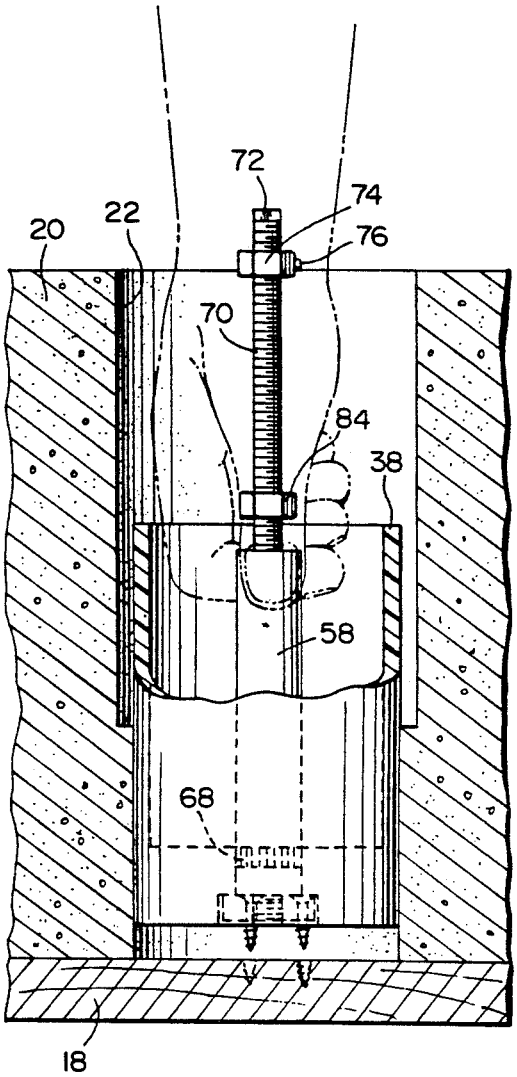
FIG. 4 is a schematic, sectional view illustrating removal of the baseplate and lower sleeve from the wood deck.
Figure 2:
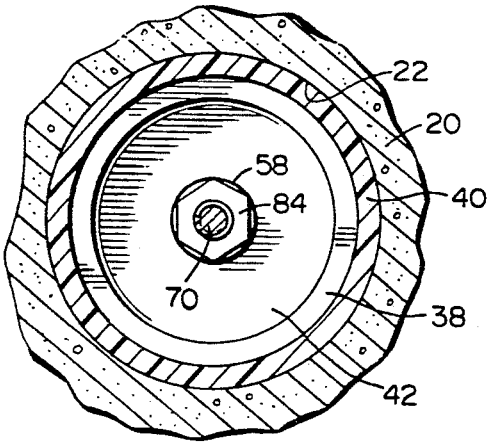
FIG. 2 is a transverse, sectional view, taken substantially upon a plane passing along section line 2—2 on FIG. 1.
Figure 3:
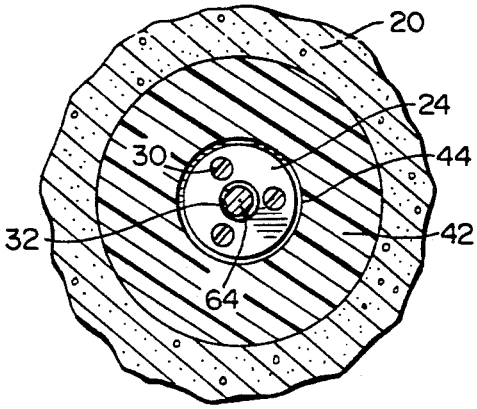
FIG. 3 is a transverse, sectional view, taken substantially upon a plane passing along section line 3—3 on FIG. 1 illustrating the structure of the baseplate.

After installation of the plate 24 by using the relatively short wood screws 30, the sleeve assembly 14 is assembled on to the plate 24 by threading the short stud 64 into the internally threaded bore 32 and the height of the sleeve assembly is adjusted by rotating the bolt 70 in a desired direction with the top surface of the top wall 46 being positioned to be substantially flush with the concrete surface when the concrete is poured. Once the desired adjustment of the rod 70 has been obtained, the upper sleeve 40 may be removed and the lock nut 84 rotated down to engage with the upper end of the tubular member 58. The upper sleeve 40 is then replaced and the cap 78 is screwed on to the upper end of the rod 70 with the lock nut 84 preventing rotation of the rod 70 in the direction of rotation of the cap 78 during installation. The concrete is then poured and permitted to set. The entire assembly can then be removed by first removing the cap 78 and engaging a wrench with the upper end 72 of the threaded rod 70 and the rod 70 is rotated in a manner to move it upwardly in relation to the tubular member 58 with the lock nut 84 disengaging from the upper end of the tubular member 58 with the threaded collar 74 engaging the undersurface of the top wall 46 of the upper sleeve 40 to move it upwardly thus extracting the upper sleeve 40 from engagement with the concrete to form the void 22. The upper sleeve 40 can be lifted upwardly as soon as it has been extracted above the surface of the set concrete as illustrated in FIG. 4 with the bottom sleeve 38, plate 24 and threaded rod 70 then being lifted up by manually gripping the rod 70 as illustrated in FIG. 4 or using a suitable tool to exert upward pressure thereon to pull the short wood screws 30 out of the wooden deck 18 thus extracting the remainder of the device from the void 22 for reuse. The sleeves 38 and 40 may be provided with a slight draft in the order of 1° in order to facilitate removal of the sleeve assembly from the concrete void 22.

The apparatus of this invention enables all work procedures to be performed before the sleeve assembly is mounted on the plate 24. The vertical adjustment of the sleeve assembly enables the apparatus to be utilized with concrete floors of difference thickness and concrete bodies having various thicknesses. The closure cap protects the threaded rod from contact with concrete and the threaded connection between the tubular member 58 and the threaded rod 70 is protected since it is interiorly of the sleeve assembly. The upper and lower sleeves may be constructed of plastic or metal and are relatively inexpensive easy to handle and provides an effective device for forming voids in a concrete floor or other concrete body.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An apparatus for forming a void through hardenable material in contact with a wood form member, said apparatus comprising a baseplate, fastener screws mounting the baseplate on the form member, a pair of telescopic sleeves with a lower sleeve being mounted on the baseplate and an upper sleeve mounted in telescopic relation to the lower sleeve, means interconnecting the sleeves to enable vertical adjustment of the overall height of the sleeves to position an upper end of the upper sleeve substantially flush with an upper surface of the hardenable material, said means enabling vertical height adjustment of the telescopic sleeves including means to move the upper sleeve upwardly in relation to the lower sleeve after the hardenable material has hardened thereby extracting the upper sleeve from the hardened material and enabling the lower sleeve and baseplate to be pulled upwardly out of the void formed in the hardenable material by pulling the fastener screws out of the wood form member, said upper sleeve and lower sleeve being generally cylindrical in configuration with the upper sleeve telescoping over the lower sleeve, said means mounting the lower sleeve on the baseplate including a threaded connection between the baseplate and the lower sleeve, said means interconnecting the upper and lower sleeves including a tubular internally threaded member rigidly mounted on the lower sleeve and a threaded rod threadedly engaged in the tubular member, the threaded rod including a collar adjustably mounted thereon for engagement with the upper sleeve to move the upper sleeve upwardly in relation to the lower sleeve in one direction of rotation of the threaded rod.

2. The structure as defined in claim 1 wherein an upper sleeve includes a passageway receiving the upper end of the threaded rod, a closure cap for the passageway forming a closure for the upper end thereof to protect the threaded rod from contact with poured concrete.

3. An apparatus for forming a passageway through a concrete body when a form is used to retain and shape at least one surface of the concrete body as it is poured and while setting, said apparatus comprising a plate adapted to be mounted on the form, a tubular sleeve assembly adapted to extend from the form to an exposed surface of the concrete body, means operable from the end of the sleeve assembly remote from the form to releasably secure the sleeve assembly to said plate with the end of the sleeve assembly adjacent the plate completely enclosing the periphery of the plate and adapted to engage the form to prevent concrete from entering the sleeve assembly and preventing concrete from contacting the plate, said sleeve assembly including inner and outer tubular, rigid sleeves having adjacent ends in close fitting telescopic relation to enable variation in length of the sleeve assembly said inner sleeve engaging the plate, means for releasably securing the plate to the form, and means operable from the end of the sleeve assembly remote from the plate to telescopically adjust said sleeves to vary the length of the sleeve assembly to correspond with the dimensions of the concrete body to position the end of the sleeve assembly remote from the form generally flush with the exposed surface of the concrete body, said means to telescopically adjust the sleeves including means within the sleeve assembly mechanically interconnecting said sleeves to force the outer sleeve away from said plate and inner sleeve to increase the length of the sleeve assembly after the concrete body has set to release the sleeve assembly from the concrete body.

4. The apparatus as defined in claim 3 wherein each of said sleeves has an end wall remote from each other, the end wall on the inner sleeve including a recess receiving said plate, said means securing the sleeve assembly to the plate including screw threaded connecting means on said plate and end wall of the inner sleeve to enable attachment of the sleeve assembly to the plate after the plate has been attached to the form and work procedures have been completed in an area which receives poured concrete without hindrance that would have been caused by sleeve assemblies attached to the form when the plates were attached thereto.

5. The apparatus as defined in claim 4 wherein said means to telescopically adjust the sleeves includes a longitudinally extending threaded means on the inner sleeve and longitudinally extending screw threaded means on the outer sleeve, said longitudinally extending screw threaded means on the inner and outer sleeves being in screw threaded engagement, said screw threaded means on the outer sleeve extending through the end wall on the outer sleeve and provided with means on an outer end for engagement by a tool to rotate the screw threaded means on the outer sleeve in relation to the outer sleeve, said screw threaded means on the inner sleeve being fixed with relation to the inner sleeve, means on the screw threaded means on the outer sleeve engaging the end wall on the outer sleeve whereby rotation of the screw threaded means on the outer sleeve will move the sleeves telescopically to adjust the length of the sleeve assembly.

6. The apparatus as defined in claim 5 wherein said end wall on the outer sleeve includes a recess in an outer surface receiving the means for engagement by a tool on the screw threaded means extending through the end wall on the outer sleeve, and a removable cap mounted on the screw threaded means extending through the end wall forming a closure for the recess and concealing the means on the outer end of the screw threaded means for engagement by a tool thereby preventing concrete from coming into contact with the screw threaded means extending through the end wall on the outer sleeve.

7. The apparatus as defined in claim 5 wherein said longitudinally extending threaded means on the inner sleeve includes a tubular internally threaded member rigidly mounted on the end wall of the inner sleeve and projecting through the inner wall on the inner sleeve and including a screw threaded terminal end, said plate including a screw threaded aperture receiving the screw threaded terminal end on the tubular internally threaded member to form said screw threaded connecting means on said plate and end wall of the inner sleeve to enable attachment of the sleeve assembly to the plate.

8. The apparatus as defined in claim 7 wherein said screw threaded means on the outer sleeve includes a threaded rod threadedly engaged in the tubular internally threaded member, said means on the screw threaded means on the outer sleeve engaging the end wall on the outer sleeve including a collar threadedly adjustably mounted on said threaded rod and engaging an under surface of said end wall on the outer sleeve to force the outer sleeve away from said plate and inner sleeve when the threaded rod is rotated in one direction thereby forcing the outer sleeve away from the inner sleeve and plate.

* * * * *